United States Patent [19]

Nicklas

[11] 4,064,293

[45] Dec. 20, 1977

[54] TREATING HOLLOW ARTICLES BY FLUID DRIVEN BUG

[76] Inventor: Manfred E. Nicklas, 1627 Redwood Drive, Harvey, La. 70058

[21] Appl. No.: 783,708

[22] Filed: Apr. 1, 1977

Related U.S. Application Data

[62] Division of Ser. No. 597,515, July 21, 1975, Pat. No. 4,036,173.

[51] Int. Cl.[2] ..... B05D 1/02

[52] U.S. Cl. ..... 427/236; 15/104.06 R; 51/411; 118/DIG. 10; 427/327

[58] Field of Search ..... 118/72, 207, 214, 305, 118/306, 317, 254, 105; 427/28, 105, 181, 183, 230–239, 299, 327, 328, 330; 51/411; 15/104.06 R; 134/166 C, 167 C, 168 C, 169 C, 22 C, 24

[56] References Cited

U.S. PATENT DOCUMENTS

| | | | |
|---|---|---|---|
| 2,332,984 | 10/1943 | Brackeen | 15/104.06 R |
| 2,480,358 | 8/1949 | Curtis et al. | 118/105 X |
| 2,821,814 | 2/1958 | Fritze | 51/411 X |
| 2,998,800 | 9/1961 | Vernooy | 118/306 X |
| 3,041,204 | 6/1962 | Green | 15/104.06 R X |
| 3,058,137 | 10/1962 | Doyle et al. | 118/DIG. 10 |
| 3,118,791 | 1/1964 | McLean | 118/DIG. 10 |
| 3,125,464 | 3/1964 | Harmes | 118/DIG. 10 |

*Primary Examiner*—Morris Kaplan
*Attorney, Agent, or Firm*—Lowe, Kokjer, Kircher, Wharton & Bowman

[57] ABSTRACT

A method of sandblasting and coating the interior surface of pipe is provided by the present invention. A plurality of legs extend outwardly from a central mounting plate and are adjustable in length and angular disposition to accommodate different sized pipe. The mounting plate has a central opening for receiving an elongated lance of either a painting or sandblasting tool. The lance carries a collar which is adapted to abut the mounting plate. A spring-biased locking pin on the mounting plate is received by the collar to releasably lock the two plates together.

The method of the invention comprises positioning the aforedescribed device in one end of the pipe and then securing a rope of a length equal to that of the pipe to the device. Next, a lightweight bucket is positioned in front of the device and the rope is coiled inside the bucket. A blast of air is then passed through the lance to move the bucket the length of the pipe. Once this has taken place the device is pulled through the pipe with the rope and the rope is moved to an out of the way location. The device is then moved back through the pipe sandblasting or painting as it travels at a steady rate.

8 Claims, 7 Drawing Figures

TREATING HOLLOW ARTICLES BY FLUID DRIVEN BUG

This is a division of application Ser. No. 597,515, filed July 21, 1975, now Pat. No. 4,036,173.

This invention relates generally to the coating of pipe and, more particularly, to a method and apparatus for coating pipe stacked in a fixed location.

All pipe used in the transmission of petroleum products is provided with a protective exterior coating. In many instances it is also desirable to protect the internal surface of the pipe with a coating. In some instances an internal coating is applied in a highly automated procedure where the pipe is rotated and may even be advanced longitudinally at the same time as a coating is sprayed around the circumference of the internal surface. In other instances because of the limitations of available equipment or a decision to coat the internal surface at a point in time after the pipe has been removed from the vicinity of the equipment it is necessary to apply the internal coating as the pipe remains in a fixed stacked location.

Heretofore, the coating of pipe stacked in a fixed location has been accomplished by moving a very long lance the length of the pipe while first sandblasting and then spray coating the internal surface. Because of the required length of the lance which moves the sandblasting and coating heads through the pipe it is extremely awkward to work in close quarters. Also, it is not unusual to encounter pipe of a length such that the operation can be performed on only half of the length and the men and equipment must then be moved to the opposite end to work on the other half of the pipe.

Accordingly, it is a primary object of the present invention to provide a method of internally coating a pipe disposed in a fixed location wherein the difficulties of working in extremely close and cramped quarters is substantially eliminated by eliminating the need for an extremely long lance at least as long as half the length of the pipe.

A further important object of the invention is to provide a method of coating pipe in a fixed location wherein regardless of the length of the pipe it is not necessary to move men and equipment from one end to the other in order to be able to coat the entire internal surface.

Another major disadvantage of prior art techniques for coating fixed in place pipe has been the dependency on the ability of the operators of the equipment for accuracy in the speed of movement of a coating head and uniformity in the positioning of the coating head relative to the central axis of the pipe.

Accordingly, it is a primary aim of the present invention to provide a method of coating the internal surface of pipe wherein a device is provided which holds the spray head of the coating lance exactly in the center of the pipe thus assuring uniformity in the application of the coating.

It is also an object of the invention to provide a method wherein a spray coating head may be pulled through the pipe at a uniform speed either manually or with automated equipment.

Still another disadvantage of prior art techniques for coating pipe in fixed locations has been the need for employing up to five manual laborers to handle the extremely long lance which must be fed into the pipe first from one end and then from the other end. An important object of the present invention is, therefore, to provide a method and apparatus for coating the internal surface of pipe wherein two laborers, one stationed at each end of the pipe, can perform the same duties which has heretofore required up to five men.

Another one of the aims of this invention is to provide a method of coating the internal surface of pipe as described in the foregoing objects which is easily adapted to accommodate pipe of different diameters.

It has also been an inherent disadvantage of known prior techniques for coating the internal surface of pipe that if more than one coating layer is required on the internal surface there is danger of striking the first layer with the equipment and damaging it as the second layer is applied. It is still another one of the objects of the present invention to provide a method of coating the internal surface of pipe wherein multiple coating layers may be applied to the internal surface with no danger of the equipment utilized during application of the second coat damaging the first coat.

Other objects of the invention will be made clear or become apparent from the following description and claims when read in light of the accompanying drawing wherein:

Figures 1, 2, 3, 4, 5, 6, 7:
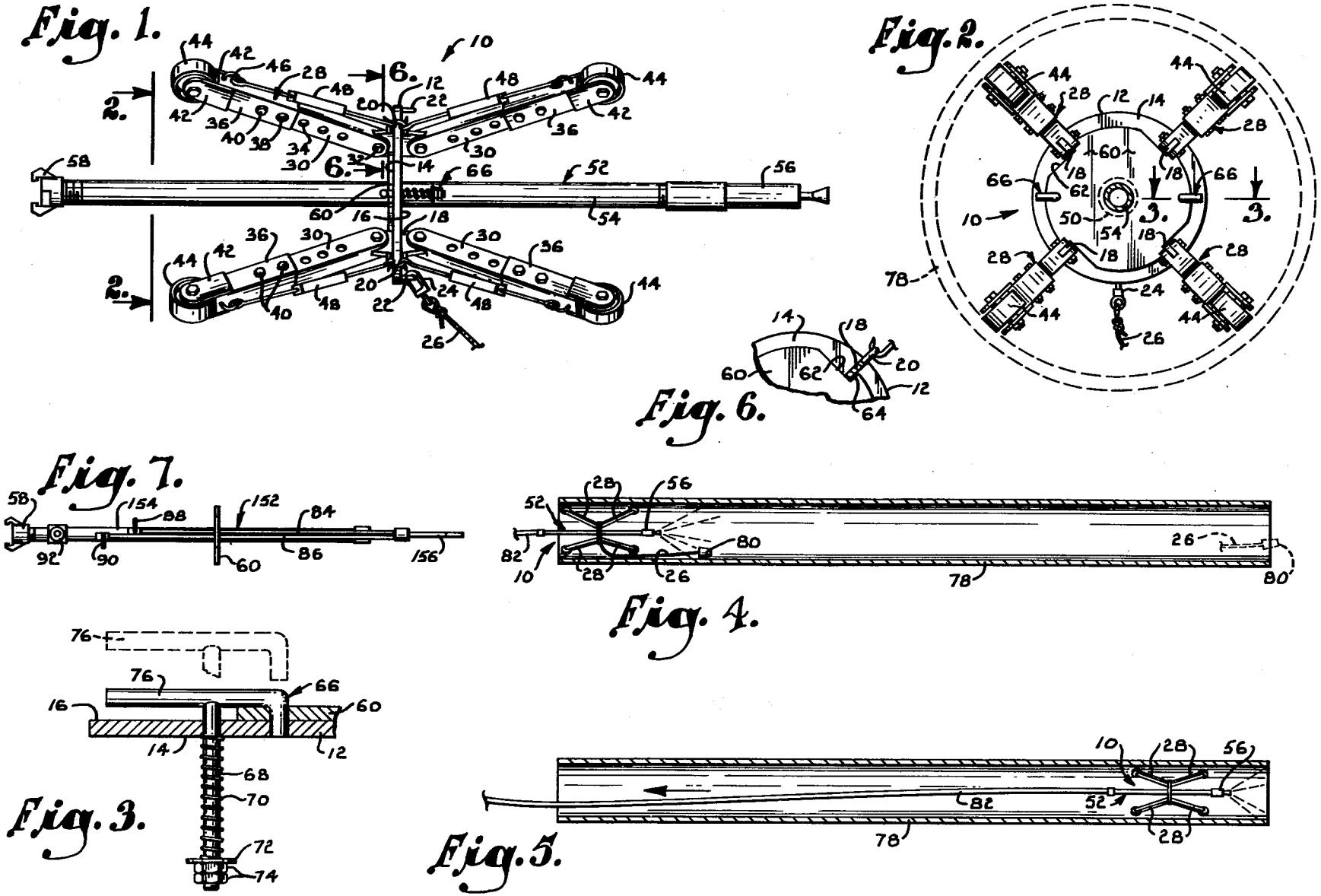
FIG. 1 is a side elevational view of the pipe working bug which forms a part of the present invention with one of its tools, a sandblasting lance and head, secured to it.
FIG. 2 is a vertical cross-sectional view taken along line 2—2 of FIG. 1 and with a pipe being illustrated in phantom surrounding the pipe working bug.
FIG. 3 is an enlarged fragmentary cross-sectional view taken along line 3—3 of FIG. 2.
FIG. 4 is a partially schematic sectional view of the pipe working device illustrated in location at one end of an elongated joint of pipe which has been shown in cross-section to reveal the interior thereof.
FIG. 5 is a view similar to FIG. 4 but illustrating the manner in which the pipe working device is moved back to its original location after it has been pulled to the end of the pipe opposite the end at which it was originally inserted.
FIG. 6 is an enlarged fragmentary elevational view showing a section of the mounting plate with one leg removed.
FIG. 7 is a top plan view of another tool which is used with the device shown in FIG. 1, namely a lance and spray coating head.

Referring initially to FIG. 1, a pipe working device is designated generally by the numeral 10 and comprises a central circular mounting plate 12 which presents opposed faces 14 and 16. Each face 14 and 16 is provided with four circumferentially spaced ears 18 which project outwardly from the respective faces. As seen from viewing FIG. 2, the ears 18 on each of the faces are disposed at approximately 2, 4, 8 and 10 o'clock positions around the face adjacent the peripheral edge. Bridging plate 12 at each opposed pair of ears 18 is a rigid loop 20 for purposes to be described hereinafter. Also extending laterally from face 16 at locations approximately 180° apart are two eyelets 22. Only one of the eyelets 22 is used at any one time to secure a swivel head 24 and a length of rope 26 attached to the swivel head.

Pivotally mounted on each ear 18 is an elongated angularly extending adjustable leg designated generally by the numeral 28. Since each of the legs 28 is identical only one will be described in detail and corresponding reference numerals will be used on each of the legs.

Each leg 28 comprises a first telescoping section 30 which is pivotally coupled with an ear 18 via a nut and bolt assembly 32. Section 30 is of generally polygonal cross-sectional configuration and is provided with aligned openings 34 on opposed sides to accommodate adjustment of the effective length of the leg.

A second telescoping section 36 is complemental in configuration to section 30 and is slidably received by the latter section. Second section 36 is also provided with aligned openings 38 on opposite sides which are adapted to be aligned with a pair of openings 34. A nut and bolt assembly 40 passing through aligned openings 34 and 38 holds the two sections of leg 28 in rigid relationship. Two outwardly extending, spaced apart brackets 42 on the end of second section 36 mount a wheel 44. Finally, a loop 46 is rigid with second leg section 36 and receives one end of a turnbuckle assembly 48. The other end of assembly 48 is received within loop 20.

As illustrated in FIG. 2, mounting plate 12 is provided with a central opening 50 for receiving a pipe working tool. Such a tool is designated generally by the numeral 52 in FIG. 1 and comprises an elongated lance 54 outfitted with a sandblasting head 56. At the end of lance 54 opposite head 56 a quick disconnect coupling 58 is provided to couple the tool 52 with a high-pressure air line.

Rigidly mounted on lance 54 at a point intermediate the ends of the lance is a collar 60 best shown in FIG. 2. Collar 60 is of generally circular configuration with cut-away notches 62 (FIG. 6) in the area of each of the ears 18. Each notch 62 presents a shoulder 64 which is disposed immediately adjacent one side of the ear so as to preclude rotation of the collar. Collar 60 is held in rigid relationship relative to mounting plate 22 by a spring-biased locking pin assembly designated generally by numeral 66 and shown in detail in FIG. 3. As indicated in FIG. 2 there actually are two locking pins 66 disposed on opposite sides of collar 60 although since both assemblies are identical only one will be described in detail. Each assembly 66 comprises a straight pin 68 which is pivotally received in an opening in the plate 12 and extends outwardly from the opposed faces 14 and 16. One end of pin 68 is provided with a coil spring 70 which is held in place by a retaining washer 72 and nuts 74.

Rigidly mounted in perpendicular relationship to straight pin 68 is an L-shaped arm 76 one leg of which is parallel to surface 16 and the other leg of which turns inwardly in perpendicular relationship to the surface. Aligned openings are provided in collar 60 and mounting plate 12 to receive the last mentioned leg of arm 76 and effectively lock collar 60 to plate 12. Manifestly, assembly 66 may be moved to the broken line position in FIG. 3 to release collar 60 and the tool 52 from plate 12.

In use, device 10 is employed to coat the internal surface of an elongated, hollow, open-ended object such as a joint of pipe 78. The length and angular disposition of legs 28 is adjusted by positioning bolts 40 in the proper holes and tightening (or loosening) turnbuckles 48. Device 10 is then positioned at one end of the pipe as illustrated in FIG. 4 and rope 26 is secured to the device as illustrated in FIG. 1. The length of rope 26 should be approximately at least as long as the length of pipe 78 although it will be appreciated that the exact length is not critical to the method of the present invention.

A lightweight object such as a plastic bucket 80 is provided and positioned in front of device 10 on the side of latter which is closest the far end of pipe 78. Rope 26 is joined to the bucket by coiling the major portion of the length of the rope inside the bucket. Next, an air line 82 is connected to lance 54 through coupling 58 to supply air to the head 56. A stream of air is passed through air line 82, lance 54 and head 56 to direct air against the bucket 80 and move the latter together with the rope inside of it the length of pipe 78 as indicated by the broken line position shown for the bucket in FIG. 4. While a short blast of air is adequate to move bucket 80 the length of the pipe, a longer blast of air will move the bucket even faster.

Device 10 may now be pulled through the pipe by an operator who is stationed at the end opposite the device pulling on rope 26. Once the device has been pulled to the far end of the pipe as illustrated in FIG. 5 the rope 26 is moved to a position where it will not interfere with cleaning or coating of the internal pipe surface. This is done by either coiling rope on the device or detaching it completely. The device is now ready to work the internal surface of the pipe and in the case of tool 52 abrasive cleaning of the surface is achieved by sandblasting. The device is pulled back along the length of pipe 78 in the direction of the arrow in FIG. 5. It is normally adequate for an operator to pull the device through at a uniform speed although in some instances it may be desirable to couple a rope with the device and wind the rope on a mechanical wench. In still other cases it is contemplated that a motor will be secured to the device to drive it along the length of the pipe.

When the device is employed to coat the internal surface a second tool 152 illustrated in FIG. 6 replaces the tool 52 described above. Coating tool 152 comprises an elongated lance 154 having a spray head 156 secured to one end. The opposite end is provided with a quick disconnect coupling 58 as previously described. A collar 60 surrounding lance 154 is of the same construction as previously described for the tool 52. First and second conduits 84 and 86 communicate with spray head 156 for delivering paint and air respectively to head during the coating operation. These conduits are provided with gate valves 88 and 90 respectively to control the flow of fluid therethrough. A valve 92 is also provided in the passage presented by lance 154 for controlling the flow of air to spray head 156. Tool 152 is secured to mounting plate 12 in same manner as described above for the tool 52. Air line 82 is coupled with lance 154 and the device 10 is positioned in the end of pipe 78 in the same manner as illustrated in FIG. 4. Since a relatively large volume of air is required to move bucket 80 the length of the pipe and a smaller volume of air is needed for atomization of the paint passing through the spray head, valves 88 and 90 are initially closed and the valve 92 is opened to direct a large blast of air only through the head to move bucket 80 the length of the pipe as aforedescribed. Valve 92 is then shutoff and valves 88 and 90 are opened to permit a smaller quantity of air along with paint to enter spray head 156. Device 10 is then pulled back through the pipe as previously described and as the internal suraface is coated with a protective coating.

It is to be appreciated that while the invention has been described with particular reference to sandblasting and coating of the internal surface of a pipe it is contemplated that the invention will find application of other types of work which are to be performed inside of an elongated hollow open-ended object.

Having thus described my invention I claim:

1. A method of working the internal surface of an elongated, hollow, open-ended object with a device capable of traveling along said internal surface, said method comprisng the steps of:

a. positioning said device in the object adjacent one of the ends;

b. securing a rope having a length approximately at least as long as the length of said object to said device;

c. providing lightweight means adapted to be moved the length of said object by an air stream;

d. positioning said lightweight means on the side of said device which is closest the other end of said object;

e. joining a section of said rope with said lightweight means at a distance along the rope removed from said device which is at least approximately equal to the length of said object;

f. directing a stream of air against said lightweight means to move the latter together with said rope along the length of said object;

g. pulling said device through said object to said other end with said rope;

h. moving the rope to a position where it will not interfere with the working operation of said device; and i. moving said device back through said object toward said one end as the device is operated to work said internal surface.

2. A method as set forth in claim 1, wherein the step of directing a stream of air comprises directing a short blast of air against said lightweight means.

3. A method as set forth in claim 1, wherein the step of providing a lightweight means comprises providing a bucket and said joining step comprises placing said rope in the bucket.

4. A method as set forth in claim 1, wherein said object comprises a joint of pipe and said device is adapted to sandblast said internal surface whereby said step of moving the device back through said object comprises sandblasting said internal surface of the pipe.

5. A method as set forth in claim 4, wherein the step of directing a stream of air comprises passing air through said device.

6. A method as set forth in claim 4 wherein said device is also adapted to spray paint said surface with a protective coating and wherein the step of directing a stream of air comprises passing air through the device and further including the additional steps of repeating steps (d), (e), (f), (g) and (h); and again moving said device back through said object to paint the internal surface of the pipe.

7. A method as set forth in claim 1, wherein said object comprises a joint of pipe and said device is adapted to spray paint said internal surface whereby said step of moving the device back through said object comprises spray painting said internal surface.

8. A method as set forth in claim 7, wherein the step directing a stream of air comprises passing air through said device.

* * * * *